US006542710B2

(12) United States Patent
Kakeshita et al.

(10) Patent No.: US 6,542,710 B2
(45) Date of Patent: Apr. 1, 2003

(54) DEVELOPING APPARATUS FOR PREVENTING DEVELOPER FROM ATTACHING TO DEVELOPER ELECTRIFYING MEMBER

(75) Inventors: Tomomi Kakeshita, Mishima (JP); Yasuyuki Ishii, Mishima (JP); Shinji Uehara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/793,082

(22) Filed: Feb. 27, 2001

(65) Prior Publication Data

US 2001/0028816 A1 Oct. 11, 2001

(30) Foreign Application Priority Data

Mar. 1, 2000 (JP) ..... 2000-056302

(51) Int. Cl.[7] ..... G03G 15/08
(52) U.S. Cl. ..... 399/281; 399/285
(58) Field of Search ..... 399/279, 281, 399/285

(56) References Cited

U.S. PATENT DOCUMENTS 4,835,565 A * 5/1989 Nagatsuna et al. ..... 399/285 X
5,077,578 A * 12/1991 Grammatica et al. ... 399/285 X
5,887,233 A * 3/1999 Abe et al. ..... 399/285 X
5,970,280 A * 10/1999 Suzuki et al. ..... 399/285 X
6,229,979 B1 5/2001 Ishii et al. ..... 399/281

FOREIGN PATENT DOCUMENTS

JP 36-10231 3/1928
JP 59-053856 3/1984

* cited by examiner

*Primary Examiner*—Fred L' Braun
(74) *Attorney, Agent, or Firm*—Fitzpatrick, Cella, Harper & Scinto

(57) ABSTRACT

A developing apparatus in which a developer is prevented from attaching to a developer electrifying member. The developing apparatus has a developer carrying body, a regulating member, and a developer carrying member, wherein during a period when developing action is not conducted by the developer carrying body and residual developer is being cleaned, there is a first period during which a first electric field is formed in a direction in which the developer normally charged moves from the developer carrying body to the developer charging member and after the first period there is a second period during which a second electric field is formed in a direction in which the developer normally charged moves from the developer charging member to the developer carrying body.

13 Claims, 13 Drawing Sheets

T1 : (DISTANCE ON DRUM BETWEEN CHARGING ROLLER AND DEVELOPING ROLLER)/PROCESS SPEED
T2, T3 : TONER CHARGING ROLLER ROTATES NOT LESS THAN ONE TIME

T1 : (DISTANCE ON DRUM BETWEEN CHARGING ROLLER AND DEVELOPING ROLLER)/PROCESS SPEED
T2, T3 : TONER CHARGING ROLLER ROTATES NOT LESS THAN ONE TIME

T2, T3 : TONER CHARGING ROLLER ROTATES NOT LESS THAN ONE TIME

T1 : (DISTANCE ON DRUM BETWEEN CHARGING ROLLER AND DEVELOPING ROLLER)/PROCESS SPEED
T2, T3 : TONER CHARGING ROLLER ROTATES NOT LESS THAN ONE TIME

DEVELOPING APPARATUS FOR PREVENTING DEVELOPER FROM ATTACHING TO DEVELOPER ELECTRIFYING MEMBER

BACKGROUND OF THE INVENTION

1. Field of the Invention

The present invention relates to a developing apparatus preferably usable for an image forming apparatus such as an electrophotographic copier and an electrophotographic printer. Here, the developing apparatus can be installed in a cartridge and the cartridge is adapted to include a developing cartridge and processing cartridge which are attachable to and detachable from a main body of an image forming apparatus. The developing cartridge is a single body of the developing apparatus and configured as attachable to and detachable from the main body of the image forming apparatus and the processing cartridge is adapted to be configured by integration of a photosensitive body with at least one of the developing apparatus, an electrifying apparatus, and cleaning means and by making it attachable to and detachable from the main body of the image forming apparatus.

2. Related Background Art

Conventionally, electrophotography is adapted to use photoconductive substance, form an electric latent image on an electrophotographic photosensitive body by various methods, then develop the latent image with a developer (toner) to make a visualized image, and in a necessary occasion, transfer the image visualized by the toner to a recording medium such as paper, followed by fixing with heat and pressure to yield an image forming matter.

At present, improving an image resolution and definition are strongly required and thus, developing a thin toner layer forming method and an apparatus thereof become necessary. For this requirement, some measures have been proposed.

In addition, in the recent years, a contact one component developing method was proposed, in which development is carried out with a configuration, in which a surface layer of the photosensitive body is pressed by using a semiconductive developing roller or the developing roller, of which surface has a dielectric layer, as a developer carrying body.

Here, FIG. 14 shows an example of the image forming apparatus of the contact one component developing system. This system is the system by which development is carried out by contacting the electrophotographic photosensitive body 21 with the developing roller 25 and using a one component developer.

First, the electrophotographic photosensitive body 21 is evenly electrified by an electrifying roller 22 which is the electrifying means for forming a latent image on the photosensitive body 21 by a laser light from an exposing unit 3, which is the static latent image forming means. Subsequently, this latent image is visualized as a toner image by the developing apparatus 24. Following this step, the toner image developed is transferred to a transfer material 13 by a transfer roller 9. The transfer material 13 is carried to a fixing device 12, where heat and pressure are applied thereto to fix the toner image, and then, the transfer material is discharged to the outside of the apparatus. On the other hand, toner 28 not transferred to the transfer material 13 and remaining on the photosensitive body 21 is removed by a cleaning blade 23, which is the cleaning means, that is contained in a waste toner containing container 29.

The developing apparatus 24 has a developer container 20 containing nonmagnetic toner 28 as the one component developer, the developing roller 25 which is the developer carrying body installed in an opening part thereof, an elastic blade 27 which is a regulating member in which the free end makes contact with the developing roller 25, and an elastic roller 26 which is a developer carrying member contacted by pressure from a position upstream from the elastic blade 27 in a rotating direction of the developing roller 25, and by rotation of the elastic roller 26 in the direction of an arrow D. Toner 28 is supplied to the surface of the developing roller 25. Toner 28 is carried according to rotation of the developing roller 25, charged with an electric charge and made into a thin layer by friction between a contacting part of the elastic blade 27 and the developing roller 25. The toner 28 that has been made into a thin layer is carried by the developing roller 25 and supplied to the contact part with the photosensitive body 21 to develop the static latent image. Following this step, toner 28, which was not developed and which remained in the contact part of the photosensitive body 21 with the elastic roller 25, is removed by the elastic roller 26. On the other hand, as described above, a new toner 28 is supplied to the developing roller 25 by the elastic roller 26 to repeat the above described action.

In recent years, with a purpose to reduce high triboelectrification stability and fog, a system, for example, U.S. application Ser. No. 167,723 (filed on Oct. 7, 1998,), now U.S. Pat. No. 6,229,979, was proposed to use means to electrically electrify toner by using a toner electrifying roller as a developer charging member.

Here, FIG. 15 shows an example of the developing apparatus using the toner electrifying roller. This developing apparatus 40 is adapted to install the toner electrifying roller 32 in the above described developing apparatus.

The developing apparatus 4 has the developer container 30 containing nonmagnetic toner 34 as the one component developer, the developing roller 35 which is the developer carrying body installed in an opening part thereof, the elastic blade 33 which is a regulating member of which the free and contacts with the developing roller 35, and the elastic roller 36 which is the developer carrying member contacted by pressure from the upstream position from the elastic blade 33 in the rotating direction of the developing roller 35, and by rotation of the elastic roller 36 in the direction of the arrow D. Toner 34 is supplied to the surface of the developing roller 35. The toner electrifying roller 32 is located between the contact part of the photosensitive body drum 31, the developing roller 35, the contact part of the elastic blade 33, and the developing roller 35. The toner electrifying roller 32 contacts the developing roller 35.

Toner 34 supplied to the surface of the developing roller 34 is carried according to rotation of the developing roller 35 to be charged with the electric charge and made to the thin layer by friction in the contacting part of the elastic blade 33 with the developing roller 35. Further, electric charging by discharge of the toner electrifying roller 32 charges the toner with an electric charge. The charged toner 34 is carried by the developing roller 35 to the contact part with the photosensitive body 31 to develop the static latent image. Following the step, toner 34, which was not developed and remained in the contact part of the photosensitive body 31 with the elastic roller 35, is removed by the elastic roller 36. On the other hand, as described above, the new toner 34 is supplied to the developing roller 35 by the elastic roller 36 to repeat the above described action.

However, in the case where such toner electrifying roller 32 is used, the following problem results: the toner electrifying roller 32 contacts the developing roller 35 and hence, toner 34 attaches to the toner electrifying roller 32 to decrease an electric charging performance of the toner electrifying roller 32. Particularly, in the case where a voltage over a discharge starting voltage is applied to the toner electrifying roller 32, the voltage applied increases and therefore, toner becomes easy to attach to the electrifying roller.

SUMMARY OF THE INVENTION

An object of the present invention is to provide a developing apparatus in which a developer is prevented from attaching to a developer electrifying member.

Another object of the present invention is to provide a developing apparatus in which the developer attached to the developer electrifying member is returned to the developer carrying member.

A further object of the present invention is to provide a developing apparatus in which stability of the electric charge of the developer is kept for a long period so as to provide a good image.

DETAILED DESCRIPTION OF THE PREFERRED EMBODIMENTS

In the following section, the developing apparatus of the present invention, the processing cartridge in which this developing apparatus is installed, and the electrophotographic image forming apparatus will be described below with reference to drawings in further detail.

Embodiment 1

A first embodiment of the present invention will be described with reference to FIG. 1 to FIG. 9.

Figure 1:
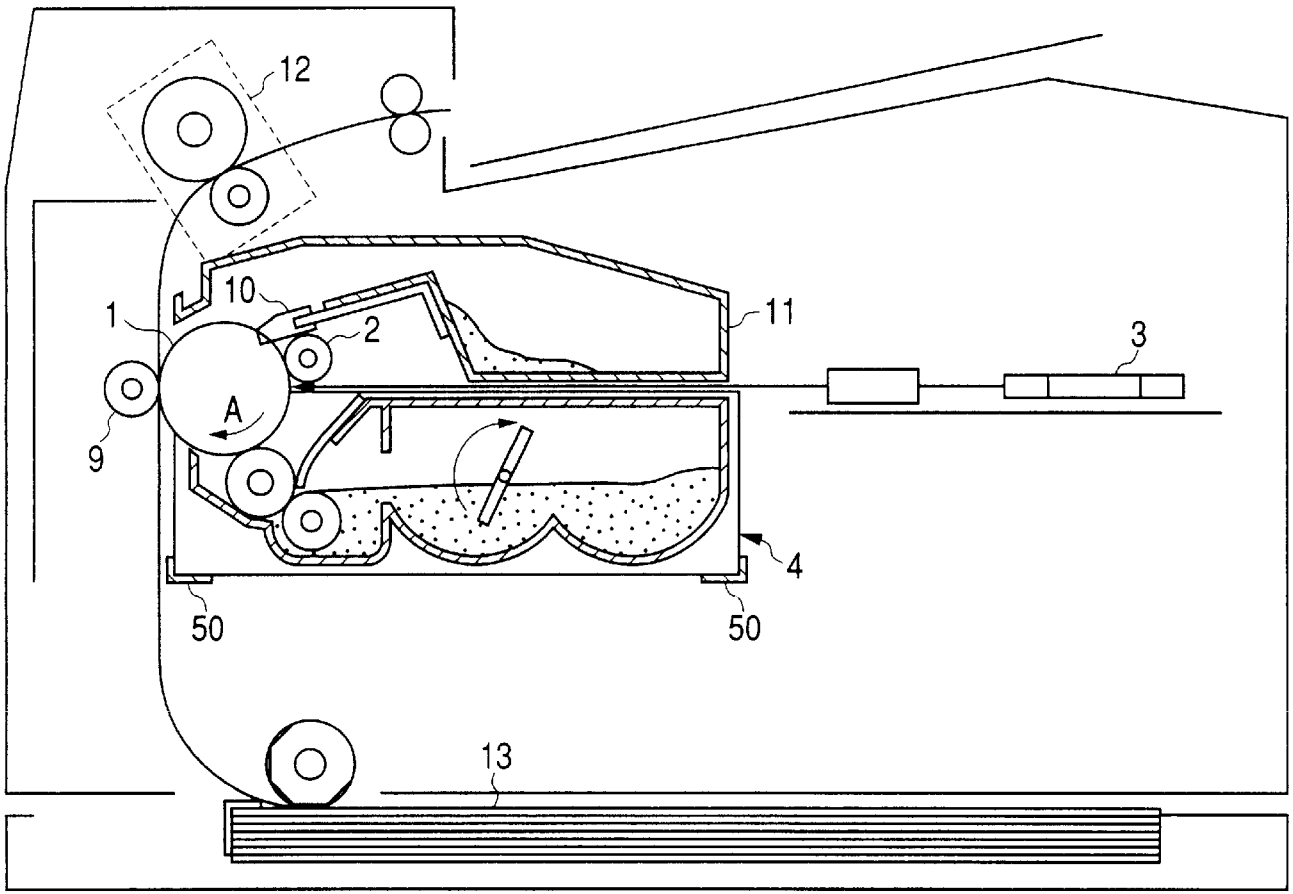
FIG. 1 is a total configuration figure showing an embodiment of the electrophotographic image forming apparatus of the present invention.

FIG. 1 shows the electrophotographic image forming apparatus of the present invention. In the FIG. 1, a photosensitive body drum 1 as an electrophotographic photosensitive body rotates in the arrow A, evenly electrified by an electrifying apparatus 2 to electrify the photosensitive body drum 1 to form the static latent image on the surface thereof by the laser light from an exposure unit 3, which is the static latent image forming means that writes the static latent image in the photosensitive body drum 1.

This static latent image is developed by the developing apparatus 4 arranged in a position near the photosensitive body drum 1 to visualize it as a toner image. In this embodiment, so-called reverse development is carried out to form the toner image in an exposure part. In addition, the developing apparatus 4 is, as the developing cartridge, attachably and detachably installed in a main body of the electrophotographic image forming apparatus by installing means 50.

The toner image visualized on the photosensitive body drum 1 is transferred to paper 13, which is a recording medium, by a transferring drum 9 and toner which has not been transferred and thus remains on the photosensitive body drum 1 is removed by the cleaning blade 10 to be contained in the waste toner containing container 11. The cleaned photosensitive body drum 1 operates the above described action repeated.

On the other hand, the paper 13, to which the toner image has been transferred, is treated for fixing by a fixing apparatus 12 and discharged to the outside of the apparatus to finish a printing action.

The developing apparatus 4 according to this embodiment will be described below with reference to the FIG. 2.

Figure 2:
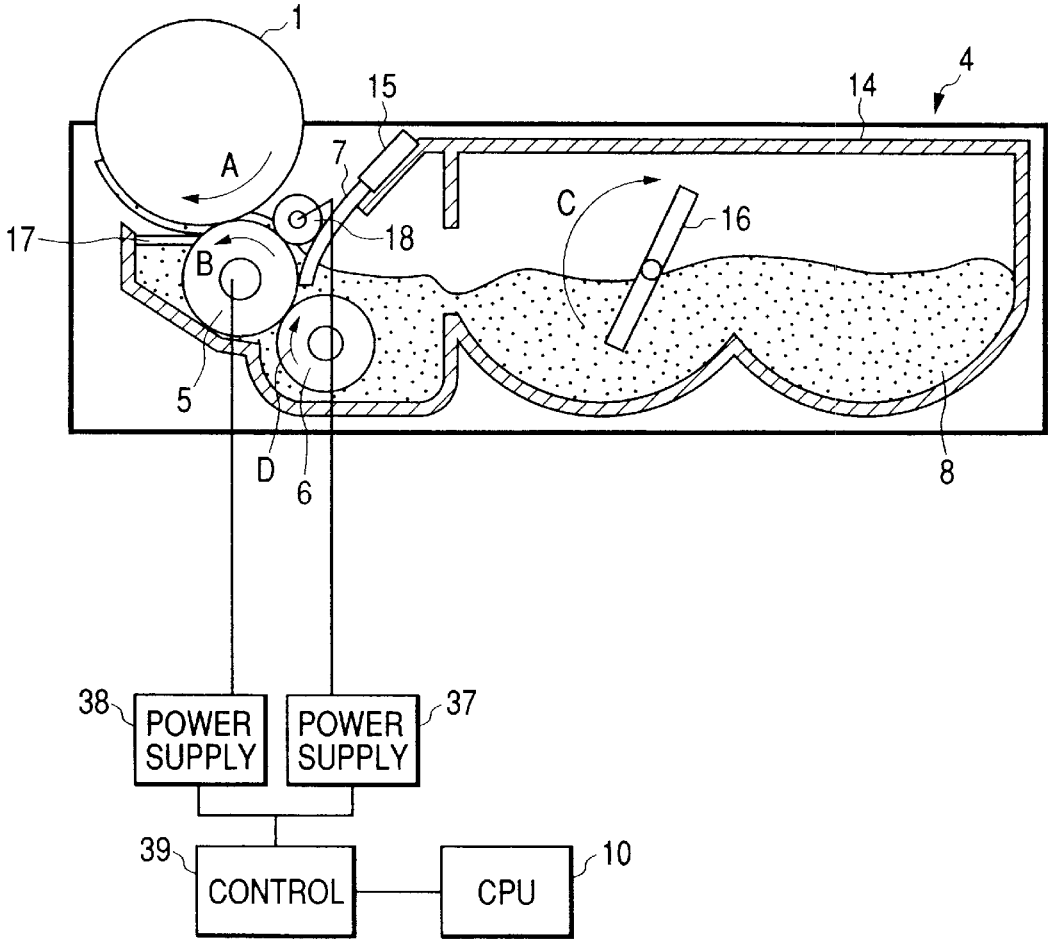
FIG. 2 is a configuration figure showing an embodiment of the developing cartridge of the present invention.

In the FIG. 2, the developing apparatus 4 has a developing container 14, in which non magnetic toner 8 is contained as the one component developer, has the developing roller 5 as the developer carrying body, which is located in an opening part extending in a length direction in the developing container 14, and installed oppositely to the photosensitive body drum 1, and is adapted to visualize the static latent image on the photosensitive body drum 1 by development. The developing roller 5 contacts to the photosensitive body drum 1 with a predetermined contacting width.

The developing apparatus 4 comprises the elastic blade 7, which is the regulating member in which the free end contacts the developing roller 5 and has the elastic roller 6, which is a developer supplying member which contacts the contact part of the elastic blade 7 with a surface of the developing roller 5 in an upstream side of rotation direction of the developing roller 5 and supported rotatively. A structure of the elastic roller 6 is preferably that of a fur brush structure in which such fiber has been implanted as rayon and nylon on a foaming network like spongy structure and a core bar in a point of toner supply to the developing roller S and removal of undeveloped toner. In this embodiment, the elastic roller 6 of a 16 mm diameter, of which core bar wire has a polyurethane foam, was used.

The contact width of this elastic roller 6 is effectively 1 to 8 mm to the developing roller 5. It is preferable that the contact part has a relative speed against the developing roller 5. In this embodiment, the contact width is set to 3 mm and rotation was driven by driving means, not illustrated, in a predetermined timing to realize that a peripheral speed of the elastic roller 6 is adapted to become 50 mm/s (the relative speed against the developing roller 5 is 130 mm/s) in developing operation.

The elastic blade 7 is supported at one end by a blade supporting plate metal 15 downstream from the elastic roller 6 and the free end thereof contacts an outer circumferential face of the developing roller 5 by surface contact. The structure thereof consists of a base body, such as rubber material silicon and urethane or a metal thin plate of SUS or phosphorous bronze having spring elasticity, the rubber material adhered to a contact face to the developing roller 5, and the like. A contacting direction is adapted to become a counter direction in which the front end is located upstream from the contact part in the rotating direction of the developing roller 5.

The elastic blade 7 according to this embodiment is adapted to be the configuration in which a plate like urethane rubber of 1.0 mm thickness is adhered to the blade supporting plate metal 15. A contact pressure against the developing roller 5 was set to 25 to 35 g/cm (=2.45 to 3.43 N/m; in measurement of a linear pressure, 3 metal thin plates of a known friction coefficient were inserted in the contact part and a value yielded by pulling out a central plate with a spring scale was converted.)

The developing roller 5 is, in the FIG. 2, installed projecting a right, almost halfway to inside the developing container 14 in the above described opening part and exposing a left, almost halfway to outside of the developing container 14 in the above described opening part. A face exposed to outside of the developing container 14 opposes to the photosensitive body drum 1 located in the left direction of the developing apparatus 4.

The developing roller 5 is rotatively driven in the direction of the arrow B and the surface thereof has a proper irregular shape to increase a probability of sliding with toner 8 and to carry toner 8 preferably. In this embodiment, the developing roller 5 used was that coated with acrylic urethane base on a silicon rubber with a 16 mm diameter, 216 mm length, and 5 mm thickness and a roller resistance was set to $10^4$ to $10^6$ Ω. The developing roller 5 is rotated by the pressure applied to the photosensitive body drum 1 in the peripheral speed of 80 mm/s which is slightly faster than the peripheral speed of 50 mm/s of the photosensitive body drum 1.

The above described resistance was measured in the following manner. An aluminum roller with a 30 mm diameter was contacted with the developing roller 5 with a contacting load of 500 gF (=4.91 N) and an aluminum pipe was rotated in the peripheral speed of 50 mm/s. Subsequently, a 40 V direct current voltage was applied to the developing roller 5. A 10 kΩ resistance was arranged in a ground side, the voltages of both ends were measured, a current was calculated, and the resistance of the developing roller 5 was calculated. A length of the developing roller 5 used was 210 mm in the length direction.

Toner 8 used according to this embodiment is a non-magnetic one component developer, and, as described above, excellent in transferring performance, high in lubrication in cleaning the remaining toner which has not been transferred onto the photosensitive body drum 1 by the cleaning means such as the blade and fur brush and therefore, has advantages such as reduced friction of the photosensitive body drum 1, and the like, i.e., it is globular in shape and smooth in surface.

A volume resistance value of toner 8 used according to this embodiment was $10^{14}$ Ω or higher. The condition of this measurement was as follows. The current was measured in an area of an electrode plate measured as 0.238 $cm^2$ in the diameter of 6 mm, the pressure of 980 $g/cm^2$ (96.1 kPa) using a weight of 1500 g, a 0.5 to 1.0 mm thickness of a powder layer in measurement, application of the direct current voltage of 400 V, and use of a microcurrent meter (YHP 4140 pA Meter/ DC Voltage source) and the volume resistance value (specific resistance) was calculated from the resistance value.

The shape index of the toner used was 100 to 180 in SF-1 and 100 to 140 in SF-2. These shape indices SF-1 and SF-2 were defined as a value yielded by calculation based on the equation given below, following random sampling of 100 toner images by using a Hitachi Ltd. made FE-SEM (S-800) and installation of an image information in a Nicolet Japan Corporation's image analysis apparatus (Luzex 3) through an interface to analyze it.

$$SF\text{-}1=\{(MXLNG)^2/AREA\}\times\{100\pi/4\}$$

$$SF\text{-}2=\{(PERI)^2/AREA\}\times\{100/4\pi\}$$

(MXLNG: absolute maximum length, AREA: toner projection area, PERI: peripheral length)

This toner shape index SF-1 shows globular degree and becomes unstable from globular shape gradually according to increases above 100. SF-2 shows surface irregularity degree and becomes prominent in irregularity of toner surface according to increase above 100.

Concerning a manufacturing method for toner, if the shape indices fall in the above described range, toner can be manufactured by employing an emulsification polymerization method, represented by dispersion polymerization method, in which toner is directly manufactured by using a suspension polymerization method described in the Japanese Patent Application Laid-Open No. 36-10231 and the Japanese Patent Application Laid-Open No. 59-53856, or a soap free polymerization method, in which toner is made by direct polymerization under presence of an aqueous, polarized polymerization initiator, as well as the manufacturing method by a so-called pulverizing method.

According to this embodiment, employing the suspension polymerization method under the condition of a normal pressure or pressurized allowing easy regulation of the toner shape indices SF-1 and SF-2 to 100 to 180 and 100 to 140, respectively, and relatively easy yield of fine particle toner with a degree distribution of sharp particles and 4 to 8 μm diameter and adding styrene and n-butylacrylate as a monomer, a metal compound of salicylic acid as electric charge regulator, a saturated polyester as a polarized resin, and a colorant to manufacture colored suspended particles with a weight average particle size of 7 μm.

By adding hydrophobic silica of 1.5 wt % from outside, negative polarity toner 8, excellent in transferring performance and less in friction in cleaning of the photosensitive body drum 1, as described above, was manufactured.

In the developing apparatus 4 described above, in developing action, toner 8 in the developing container 14 is sent to the elastic roller 6 according to rotation in the direction of the arrow C of a stirring member 16.

Subsequently, toner 8 is sent to the position near the developing roller 5 by rotation of the elastic roller 6 in the direction of the arrow D. In the contacting part of the developing roller 5 to the elastic roller 6, toner 8 held on the elastic roller 6 is scrubbed by the developing roller 5 to be charged by friction finally resulting in attaching to the developing roller 5.

Following this step, toner 8 is, according to rotation of the developing roller 5 in the direction of the arrow B, sent to the place pressurized by the elastic blade 7 to be made the thin layer on the developing roller 5. According to this embodiment, setting is conducted to adapt to yield −60 to −20 $\mu$C/g as a good electrified charge amount, 0.4 to 1.0 $mg^2$ as a good toner coating amount, and 10 to 20 $\mu$m in thickness of the toner layer. As described above, a normal electrifying polarity of toner is negative.

To keep the electrifying polarity of toner 8 as described above higher, a toner electrifying roller 18 is contacted to all image forming areas formed on the developing roller 5 and electrifies toner by electric discharge. The toner electrifying roller 18 is a rubber roller and contacting load thereof the developing roller 5 by a pressurizing member, not illustrated, installed in both ends thereof is 100 to 200 gF (=0.98 to 1.96 N.) By contact of the toner electrifying roller 18, toner 8 is densely filled and coated evenly. Concerning a positioning relation between the elastic blade 7 and the toner electrifying roller 18 in the length direction, it is preferable to arrange allowing the toner electrifying roller 18 to cover reliably all areas, in which the elastic blade 7 contacts to the developing roller 5.

The method for electric charging will be described below.

Figure 3:
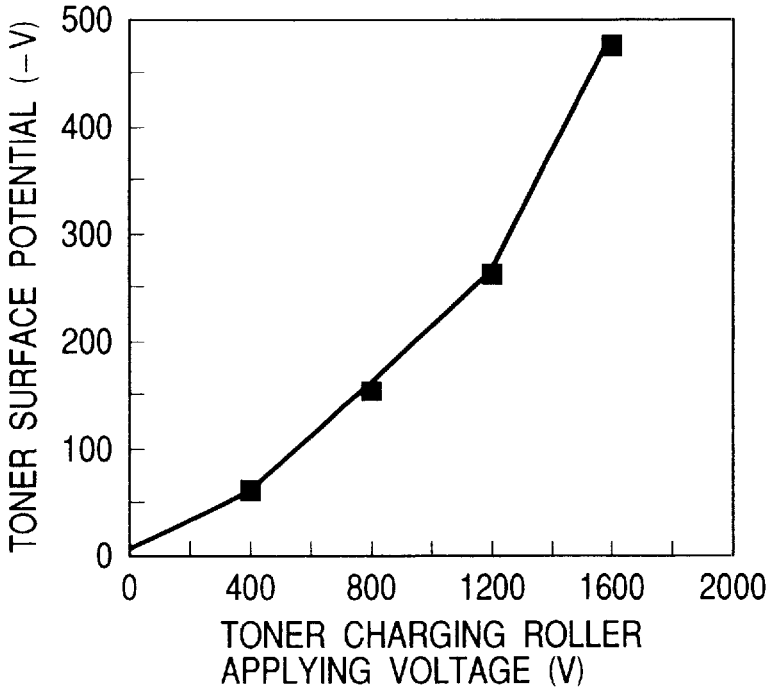
FIG. 3 is a graph showing a toner electrifying characteristic in case of injection electrification.
Figure 4:
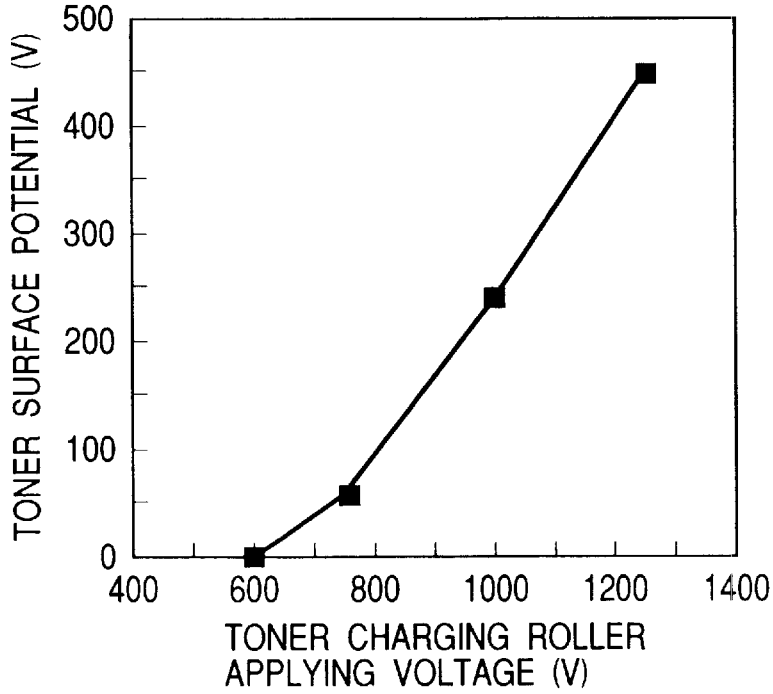
FIG. 4 is a graph showing the toner electrifying characteristic of a toner electrifying roller of $10^6$ Ω.

As shown in the FIG. 3, in the case where the resistance of the toner electrifying roller 18 is $10^8$ Ω, the resistance of the developing roller 5 is $10^4$ Ω, and the bias voltage is not applied to the developing roller 5, a surface electric potential of toner 8, which is electrified on the developing roller, against the applied voltage shows a behavior shown with a solid line. Toner 8 on the developing roller 5 electrified by friction with the elastic blade 7 has the surface electric potential of −20 V, even when the applied voltage is 0 V. Excluding this surface electric potential caused by frictional electrification, as shown in the FIG. 4, the discharge starting voltage across the toner electrifying roller 18 and toner 8 rises at −600 V with inclination of 1 and shows behavior similar to that of DC discharge electrification of the photosensitive body drum 1.

Another method for electric charging and electrification of toner is the injection electrification method. Relation between a toner electrifying roller voltage and the toner surface electric potential show behaviors shown in the FIG. 3.

From the above described results, it can be said that electric charging and electrification of toner by the toner electrifying roller 18 in this embodiment is carried out by applying electric discharge phenomenon.

The discharge starting voltage across the toner electrifying roller 18 and toner 8 is determined by an intersection point of the equations (1) and (2) presented below.

$$Vb=312+6.2\ g \quad (1)$$

$$Vg=b(Va-Vc)/((Lt/Kt)+g \quad (2)$$

In the above described equations, g: spacial distance

Vb: approximate expression of Pschen's Law in g>8 $\mu$m

Vg: voltage between spaces surfaces of the toner electrifying roller and the toner layer.

Va: Voltage applied to the toner electrifying roller

Vc: electric potential of the surface of the toner layer

Lt: thickness of the toner layer

Kt: specific dielectric constant of the toner layer

Toner 8 used in this embodiment is excellent in particle distribution and shape thereof of globular and thus, a proportion of toner to air in the toner layer is constant. Therefore, Kt in the expression (2) becomes stable and electric charging is carried out by stable electric discharge.

Next, the range of resistance capable of electric discharge for toner is studied. As the result, in the case where the resistance of the toner electrifying roller 18 is equal to or less than $10^7$ Ω, abnormal discharge occurs between the toner electrifying roller 18 and toner coated part of the developing roller 5 to cause formation of an inappropriate image. On the other hand, in the case where the resistance of the toner electrifying roller 18 is equal to or more than $10^{12}$ Ω, the discharge starting voltage is too high and therefore, the performance to electrify toner was not yielded. From these facts, it has been known that an appropriate range of the resistance of the toner electrifying roller 18 is $10^8$ to $10^{11}$ Ω. In this embodiment, an upper limit of the resistance of the developing roller 5 is set to $10^6$ Ω and hence, this value falls in the above described range.

Measurement of the above described resistance was as follows. The aluminum roller with a 16 mm diameter was contacted with the toner electrifying roller with the contacting load of 170 gF (=1.67 N) and the aluminum roller was rotated in the speed of 80 mm/s. Subsequently, a −400 V direct current voltage was applied to the toner electrifying roller. The 10 kΩ resistance was arranged in the ground side, the voltages of both ends were measured, the current was calculated, and the resistance of the toner electrifying roller was calculated. The length of the toner electrifying roller used was 210 mm in the length direction.

Figure 5:
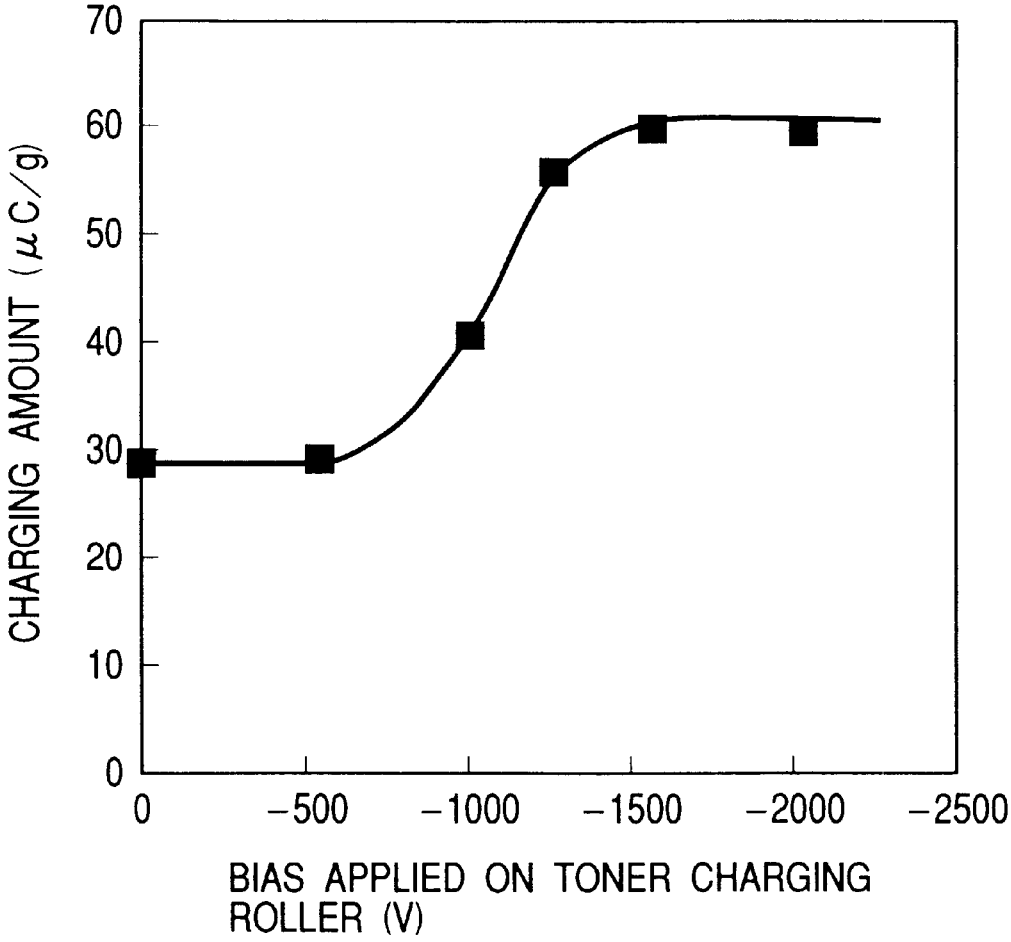
FIG. 5 is a graph showing a relation between an electric charge application bias to the toner electrifying roller and an electrifying charge of a first embodiment of the present invention.

The voltage across the toner electrifying roller 18 and toner 8 on the developing roller 5 is saturated at 1200 V as shown in the FIG. 5. In this embodiment, in order to carry out safety discharge, the electric potential between the developing roller 5 and the toner electrifying roller 18 was set to become 1500 V. According to this operation, when the direct current voltage of the developing roller 5 is set to −300 V, the direct current voltage of the toner electrifying roller 18 was set to −1800 V.

Subsequently, the toner layer made into the thin layer on the developing roller 5 is evenly carried to a developing part which is an opposite part to the photosensitive body drum 1. In this developing part, the toner layer made into the thin layer on the developing roller 5 is developed as the toner image on the static latent image on the photosensitive body drum 1 by the direct current voltage of the developing roller 5.

Undeveloped toner not consumed in the developing part is collected from a bottom part of the developing roller 5 according to rotation of the developing roller 5. In this collecting part, a seal member 17 consisting of a bendable sheet is set to allow undeveloped toner to pass to the inside of the developing container 14 and prevents the leakage of a toner 8, which is contained in the developing container 14, from the bottom part of the developing roller 5.

Undeveloped toner collected on the developing roller 5 is removed from the surface of the developing roller 5 in the contact part of the elastic roller 6 to the developing roller 5. A large part of the toner removed is carried according to rotation of the elastic roller 6 and mixed with toner 8 in the developing container 14 to disperse electric charge of the toner that has been electrified. Simultaneously, by rotation of the elastic roller 6, new toner is supplied on the developing roller 5 to repeat the above described action.

As described above, by configuring with installation of the toner electrifying roller 18, after toner 8 has passed through the elastic blade 7, electric charging is carried out by the toner electrifying roller 18 to keep the charge of the electrified toner 8 high.

Next, cleaning of the toner electrifying roller 18 according to this embodiment will be described.

Staining toner on the toner electrifying roller 18 has been attached by an electrostatic force. Changing an electric field strength of the toner electrifying roller 18 and the developing roller 5 allows cleaning the toner electrifying roller 18 to reduce staining toner. Staining toner is electrified with positive polarity, which is the reversed polarity of the normal electrification polarity of toner.

Figure 6:
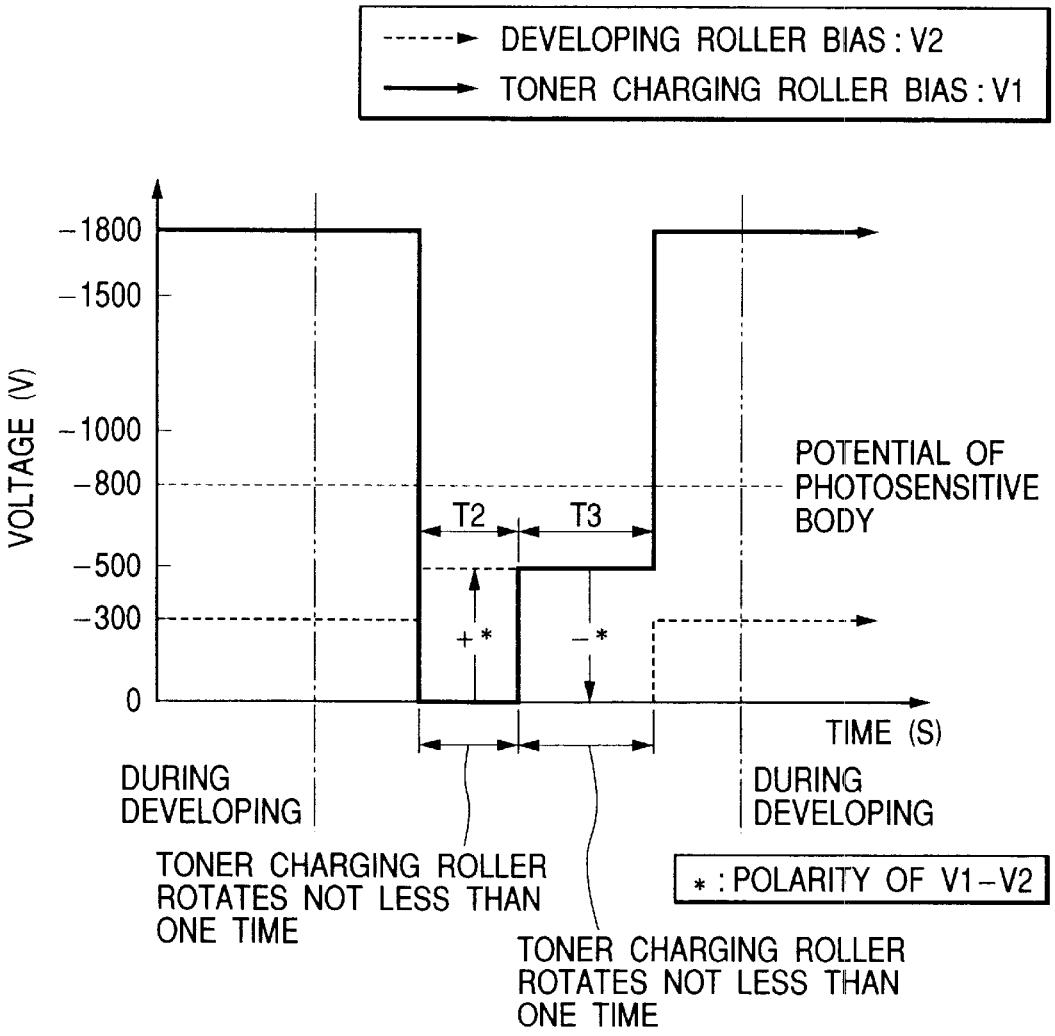
FIG. 6 is a figure showing a cleaning sequence bias of the first example of the present invention.

Here, electric potential relation between the developing roller 5 and the toner electrifying roller in cleaning of the toner electrifying roller 18 with reference to the FIG. 6.

The cleaning sequence of this embodiment is the sequence, in which the voltage is changed to collect once toner, which is electrified with the normal polarity, on the developing roller 5 by the toner electrifying roller 18 and then, together with stained toner electrified with normal and reversed polarities, toner, which is electrified with the normal polarity, on the toner electrifying roller 18 is discharged on the developing roller 5. In other words, when normal toner is returned from the toner electrifying roller 18 to the developing roller 5, a small amount of reversed toner, which presents in normal toner, is also returned from the toner electrifying roller 18 to the developing roller 5. For reference, toner according to this embodiment is, as described above, negative toner.

The difference in electric potential V1−V2 between the electric potential V1 of the toner electrifying roller 18 and electric potential V2 of the developing roller 5 shows+ polarity in an electric potential relationship in the case where normal toner is returned to the toner electrifying roller 18 and negative polarity in the electric potential relationship in the case where normal toner is discharged to the developing roller 5. In addition, V1−V2 satisfies the following relation.

$$Vth-100<V1-V2<Vth$$

Vth: The discharge starting voltage across the toner electrifying roller and the developing roller.

Such action is performed by switching an output of a first power supply 37 connected to the toner electrifying roller 18 shown in the FIG. 2 to the output of a second power supply 38 connected to the developing roller 5, shown in the FIG. 2, by a CPU 10 through control means 39.

Relation between respective electric potentials are adapted to continue while the toner electrifying roller 18 rotates 1 cycle or more. By this, amount of the reversed toner for all circumference of the toner electrifying roller can be returned to the developing roller 5.

In this embodiment, a time of continuation of collection bias potential and the time of continuation of sweeping out bias potential are adapted to T2=0.5 s and T3=1.2 s, respectively.

During the operation of the toner transfer sequence, in order to suppress toner consumption and prevent staining of the photosensitive body drum 1 by toner, it is preferable to keep potential of the photosensitive body drum 1 to potential in which toner is not developed. In this embodiment, potential on the photosensitive body drum 1 is set to −800 V.

Figure 7:
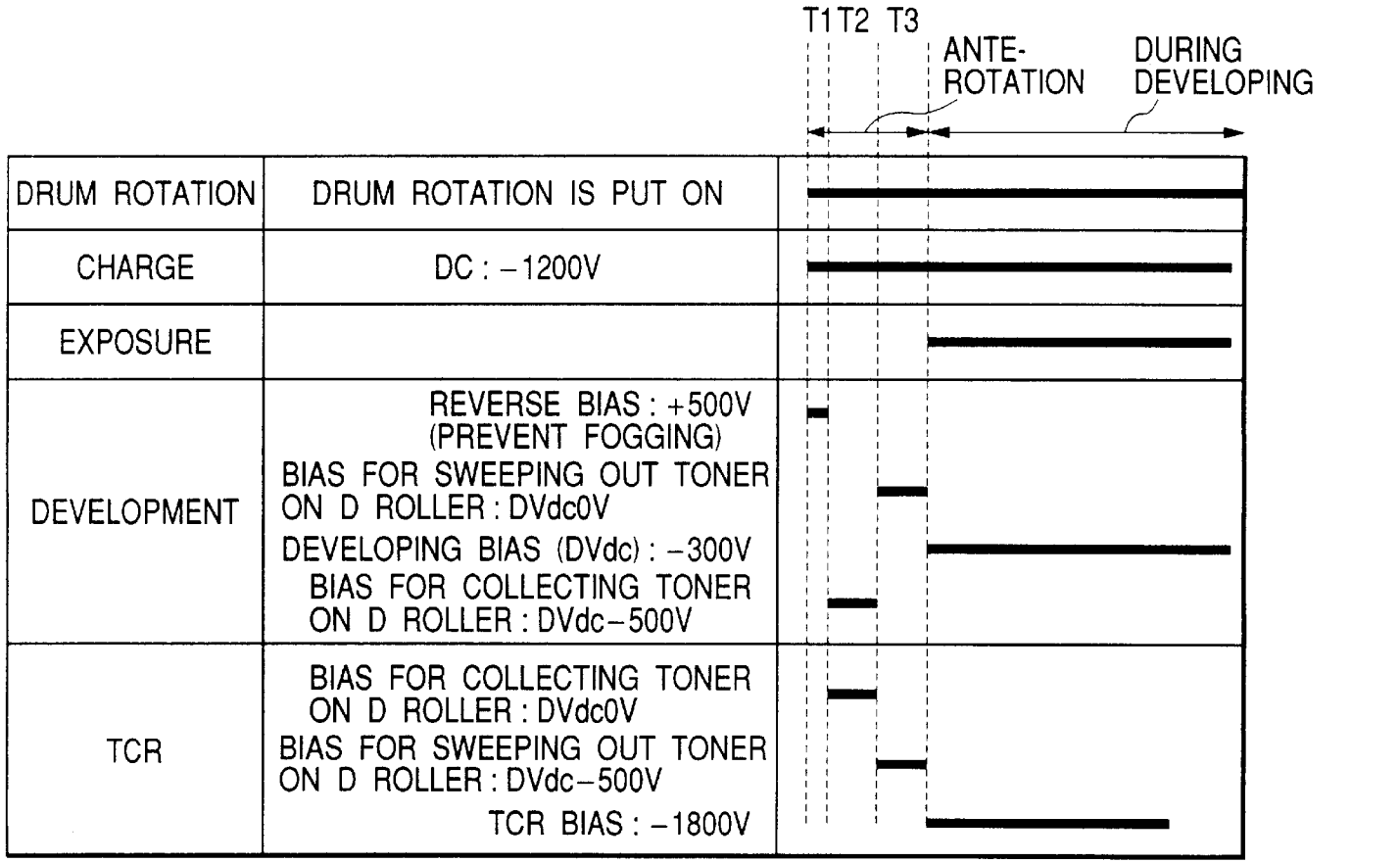
FIG. 7 is a cleaning sequence chart of the first embodiment of the present invention.

Next, the cleaning sequence chart of this embodiment will be shown in the FIG. 7.

Cleaning of the toner electrifying roller (TCR) 18 is, in pre-rotation from input of an image forming start signal to start of image formation, started immediately after rotation of the drum is begun and finished immediately before a developing potential for development of the static latent image by toner is applied to the developing roller.

Rotation of the photosensitive body drum 1 and electrification by the electrifying apparatus 2 are carried out simultaneously. The reversed bias of +500 V is applied to the developing roller 5 for the time T1 to prevent fogging. Here, T1 time=(distance between electrifying roller and developing roller on the drum/ processing speed).

Next, as the toner collection bias DVdc on the developing roller, −500 V and 0 V are simultaneously applied to the developing roller 5 and the toner electrifying roller (TCR) 18, respectively, for T2 time (in this embodiment, 0.5 s) and subsequently, as the sweeping out bias on the developing roller, 0 V and −500 V are simultaneously applied to the developing roller 5 and the toner electrifying roller (TCR) 18, respectively, for T3 time (in this embodiment, 1.2 s).

Immediately after cleaning of the toner electrifying roller 18 is completed, a developing step is started to simultaneously apply biases of Dvdc=−300 V and Dvdc=−1800 V to the developing roller 5 and the toner electrifying roller 18, respectively, to carry out development, charging electrically toner on the developing roller by the electrifying roller.

Figure 8:
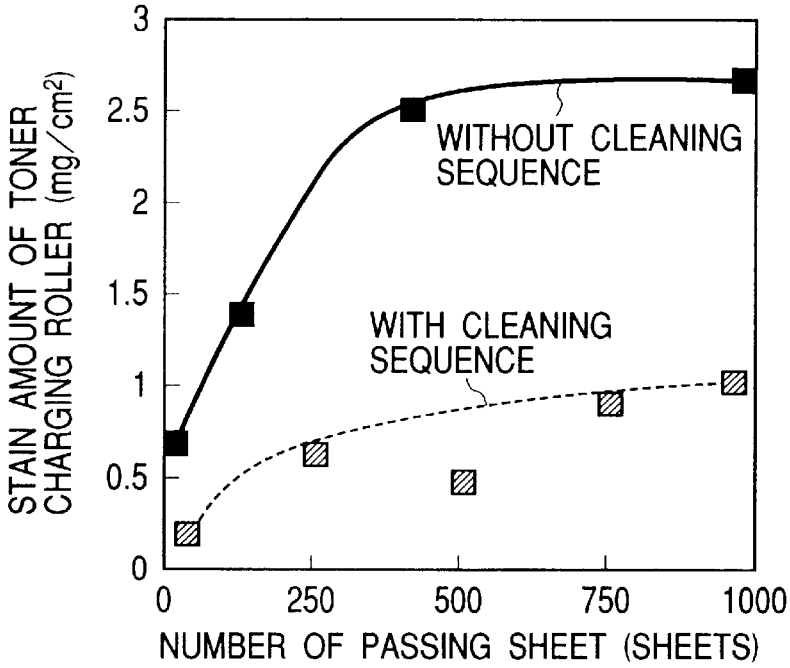
FIG. 8 is a figure showing the relation between a passed sheet of paper and a stained amount of the toner electrifying roller of the first embodiment of the present invention.
Figure 9:
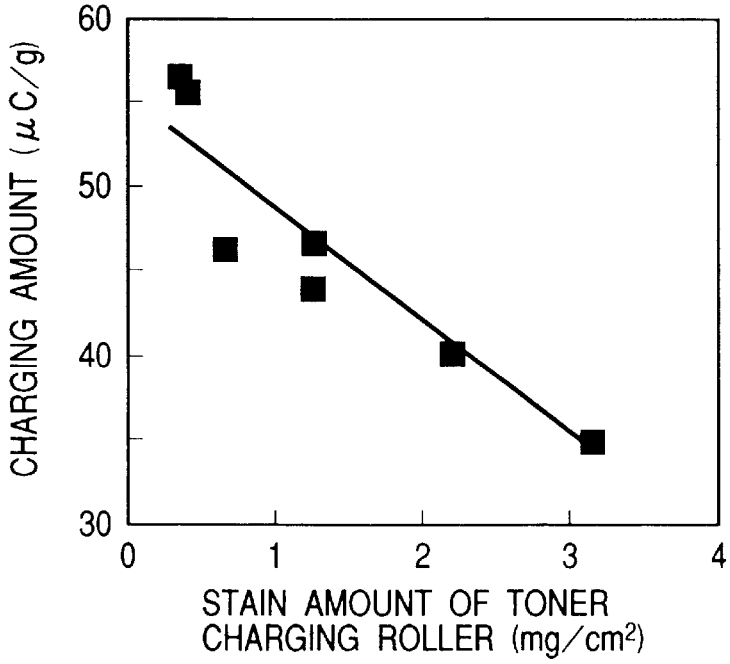
FIG. 9 is a figure showing the relation between the stained amount of the toner electrifying roller and electrifying charge of the first embodiment of the present invention.

Here, the FIG. 8 shows the number of sheets of paper passed and the staining amount of the toner electrifying roller in the cases where the cleaning sequence is introduced and not introduced in a 2-sheet intermittent mode. The FIG. 9 shows staining amount of the toner electrifying roller and the electric charge of toner. As shown by the solid line of the FIG. 8 and in the FIG. 9, in the case where the cleaning sequence is not introduced, staining toner attaches to the toner electrifying roller according to progress of tolerance to decrease electrifying performance. However, in the cases where the cleaning sequence is introduced, as shown by a dotted line of the FIG. 8, an amount of staining toner attached to the toner electrifying roller decreases to provide the stable electric charge to toner on the developing roller.

From the above described results, as shown in the FIG. 8, for example in 250 sheets of paper passed, the amount of staining toner attached to the toner electrifying roller can be decreased from 2.0 (mg/cm$^2$) to 0.6 (mg/cm$^2$.)

As described above, according to this embodiment, toner attachment to the toner electrifying roller can be prevented and toner on the developing roller can be stably charged electrically for a long period, resulting in yield of a good image.

Embodiment 2

Next, a second embodiment of the present invention will be described with reference to FIG. 10 and FIG. 11

This embodiment is characterized in that in the contact developing system by using the toner electrifying roller, after developing action is carried out, in other words, during post-rotation, cleaning action is performed for the toner electrifying roller.

Figure 10:
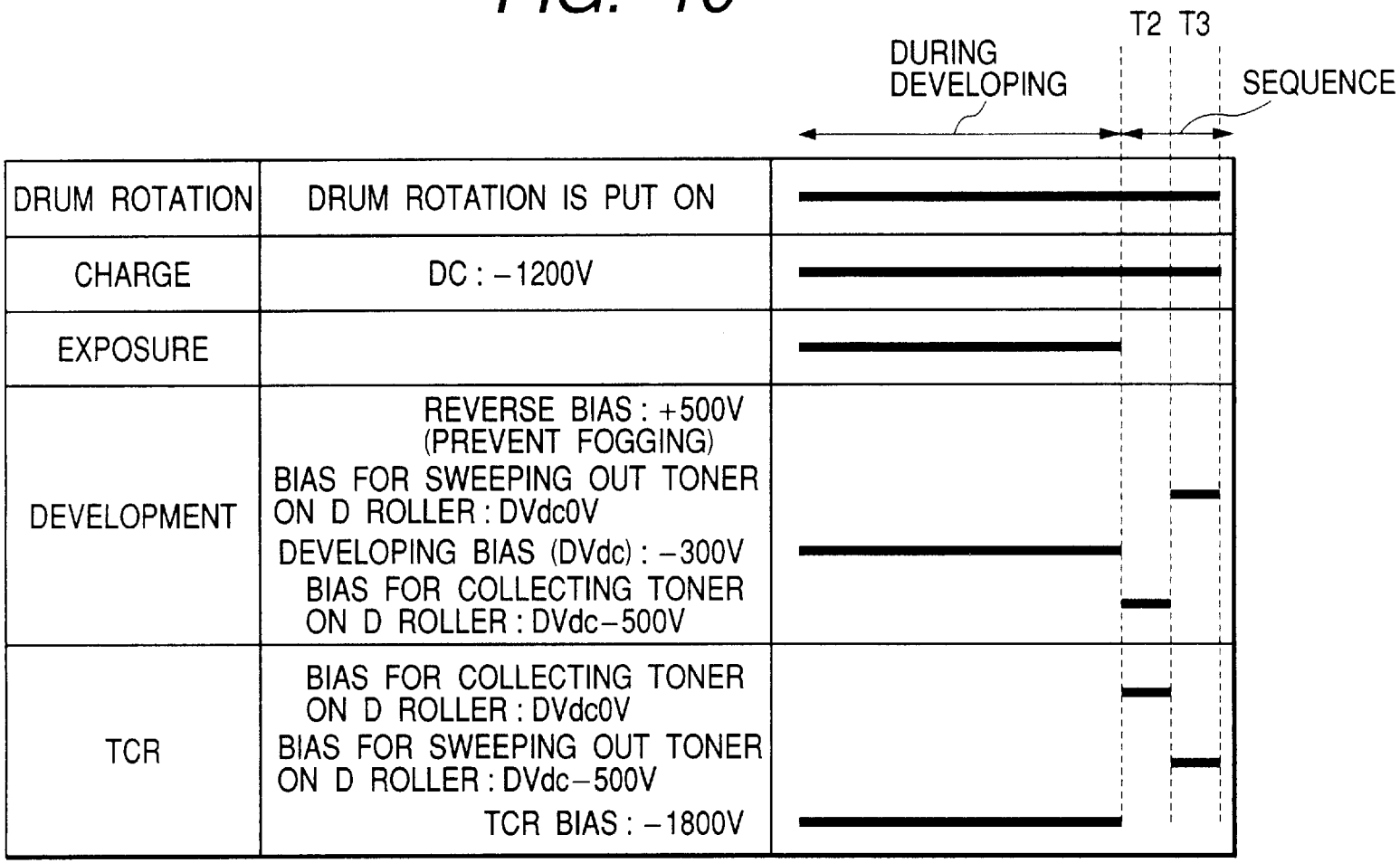
FIG. 10 is a cleaning sequence chart of a second embodiment of the present invention.

FIG. 10 shows the sequence chart of this embodiment.

As known from the FIG. 10, in this embodiment, cleaning is carried out once after every developing action for 1-sheet printing. Relation in cleaning action in this embodiment between the voltage V1 applied to the toner electrifying roller 18 and the voltage V2 applied to the developing roller 5 are same as those of the first embodiment and therefore, explanation will be omitted.

For reference, in FIG. 10, in the case where a printing signal occurs in post-rotation, the developing action should be conducted after cleaning action is completed.

Figure 11:
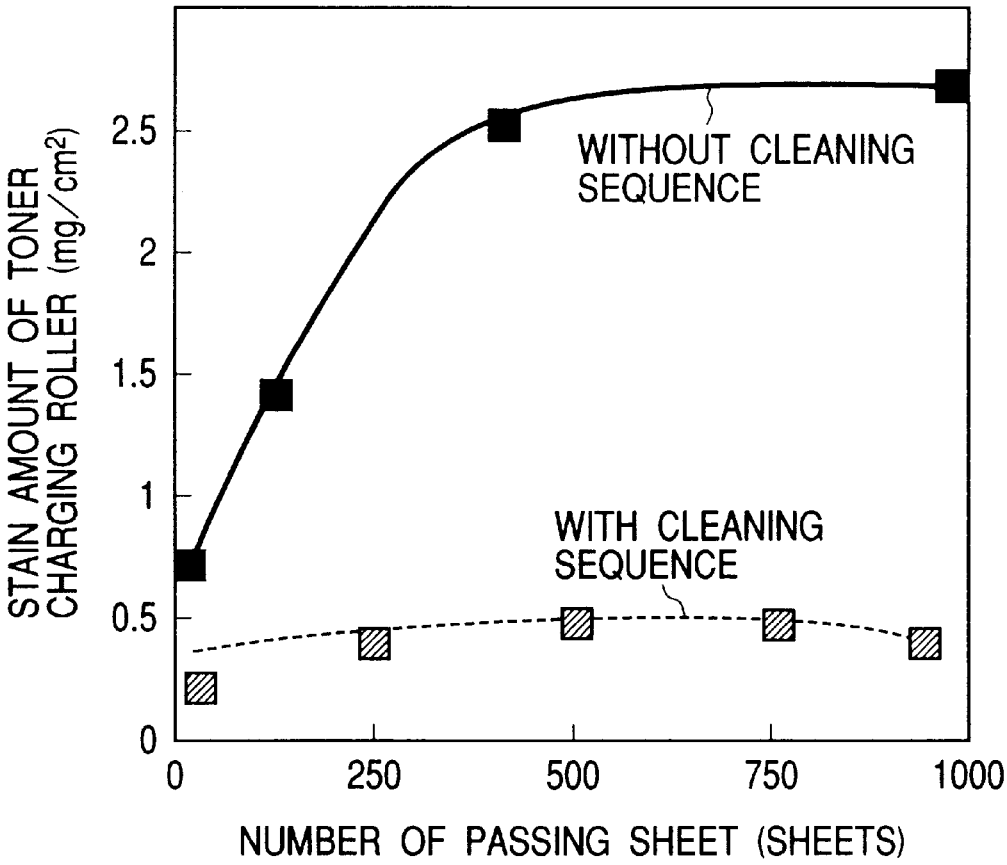
FIG. 11 is a figure showing the relation between the passed sheet of paper and a stained amount of the toner electrifying roller of the second embodiment of the present invention.

By executing this sequence, it is realized in an experiment carried out in the 2-sheet intermittent mode, as shown with a broken line in the FIG. 11, even if tolerable sheet number increases, it is realized that staining toner to attach to the toner electrifying roller 18 can be reduced to 0.4 (mg/cm$^2$).

As described above, it is realized that more stable electric charging of toner on the developing roller becomes possible to yield the stable image.

Embodiment 3

Next, a third embodiment of the present invention will be described with reference to the FIG. 12 and FIG. 13.

This embodiment is characterized in that in the contact developing system by using the toner electrifying roller, before and after the developing action is carried out, in other words, during pre-rotation and sheet interval or the post-rotation, cleaning action is performed for the toner electrifying roller.

Figure 12:
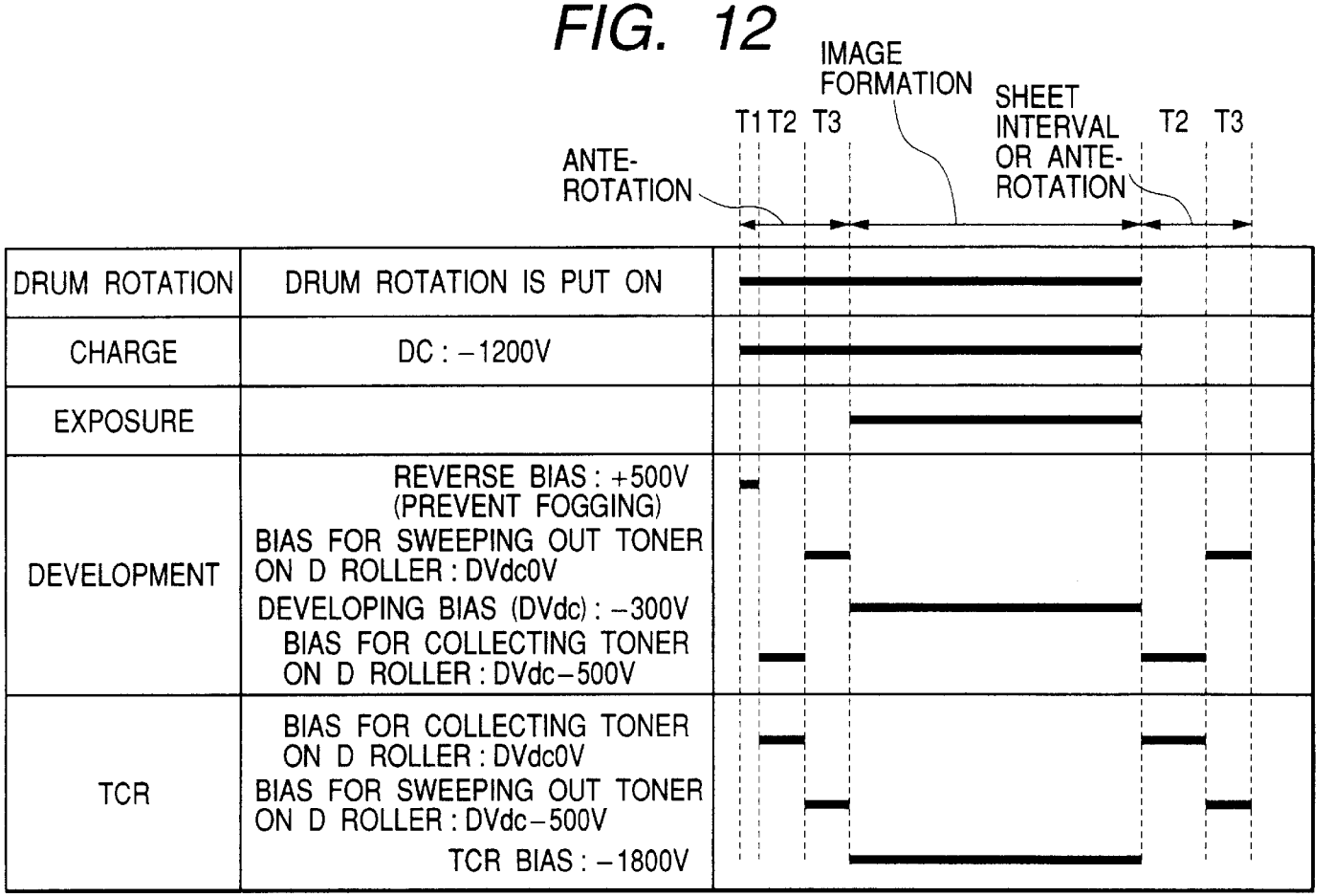
FIG. 12 is a cleaning sequence chart of a third embodiment of the present invention.

FIG. 12 shows the cleaning sequence chart of this embodiment.

As known from the FIG. 12, in this embodiment, cleaning is carried out once before and after every developing action for 1-sheet printing. Relation in cleaning action in this embodiment between the voltage V1 applied to the toner electrifying roller 18 and the voltage V2 applied to the developing roller 5 are same as those of the first embodiment and therefore, explanation will be omitted. For reference, in FIG. 12, the same as that of the second embodiment, in the case where a printing signal occurs in post-rotation, the developing action should be conducted after cleaning action is completed.

Figure 13:
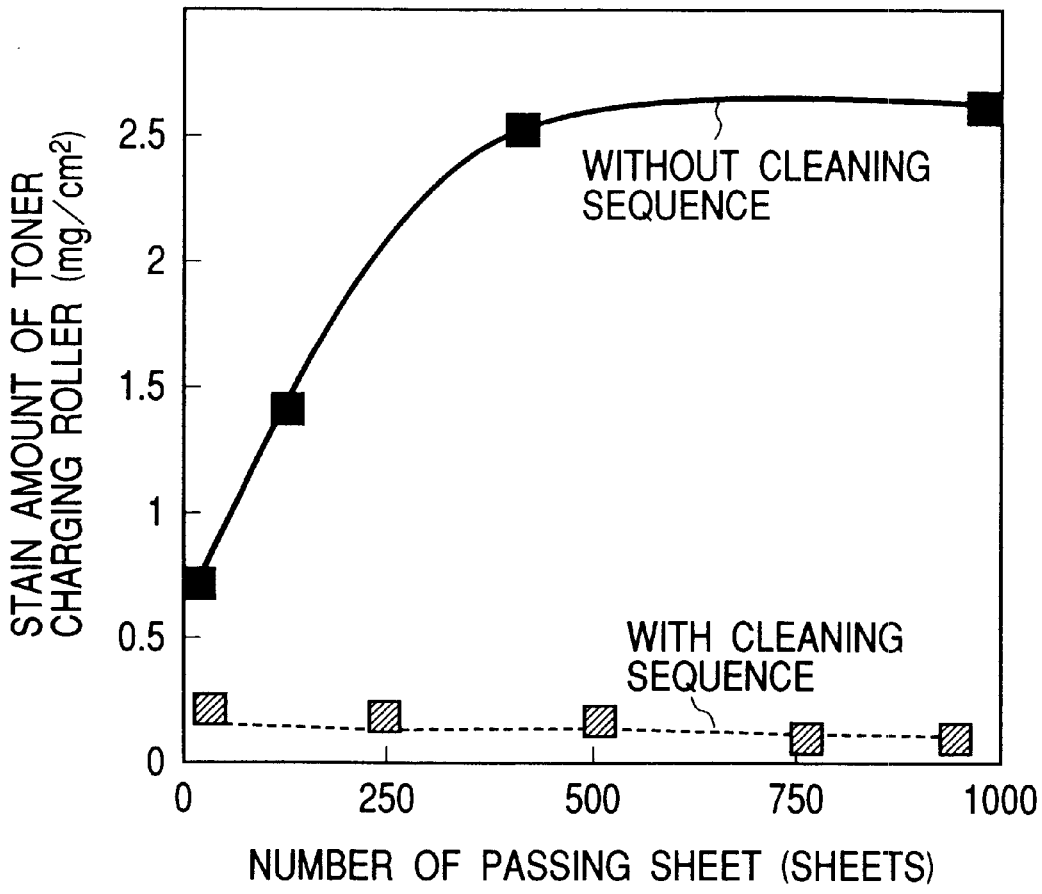
FIG. 13 is a figure showing the relation between the passed sheet of paper and a stained amount of the toner electrifying roller of the third embodiment of the present invention.
Figure 14:
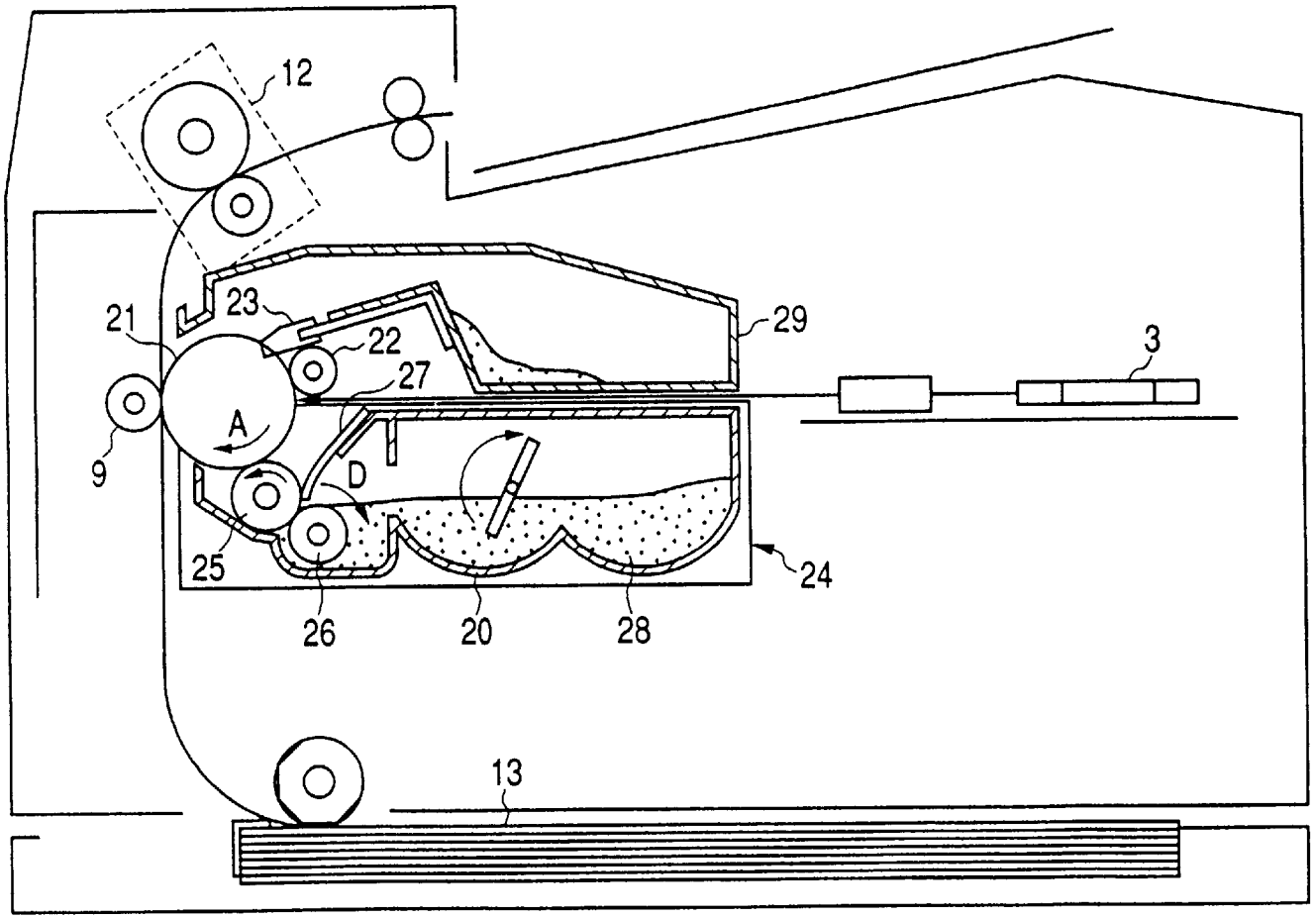
FIG. 14 PRIOR ART
FIG. 14 is a figure showing an example of a conventional image forming apparatus.
Figure 15:
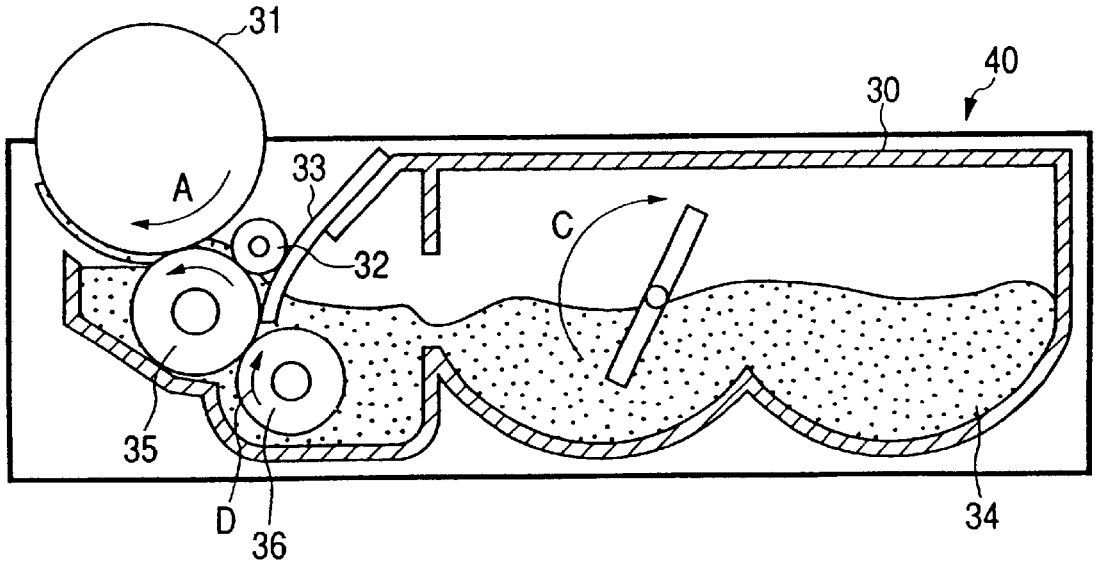
FIG. 15 PRIOR ART
FIG. 15 is a configuration figure showing an example of the developing apparatus having a conventional toner electrifying roller.

By executing this sequence, it is realized that in an experiment carried out in the 2-sheet intermittent mode, as shown with a broken line in the FIG. 13, even if tolerable sheet number increases, staining toner to attach to the toner electrifying roller 18 can be reduced to 0.2 ($mg/cm^2$.)

As described above, according to this embodiment, it is realized that electric charging, more stable than the first and second embodiments, of toner on the developing roller becomes possible to yield the stable image.

For reference, in the above described embodiments 1 to 3, the developing cartridge comprising the developing apparatus is adapted to be configured attachably to and detachably from the main body of the image forming apparatus. However, the developing cartridge can be plural and particularly, can be preferably applied to the image forming apparatus of the color electrophotography system necessary of a characteristic that is stable gradation of each color, in other words, the stably electrified charge. In addition, the configuration may be that the developing apparatus is fixed to inside of the main body of the image forming apparatus and toner only is supplied. Furthermore, the developing apparatus is integrated with the photosensitive body drum, cleaning blade, waste toner container, and electrifying apparatus to use as the processing cartridge attachable to and detachable from the main body of the image forming apparatus.

What is claimed is:

1. A developing apparatus comprising:

a developer carrying body for carrying a developer to a developing position, said developer carrying body developing an electrostatic image on an image bearing body with the developer in the developing position;

a regulating member for regulating a thickness of a layer of the developer carried by said developer carrying body; and a developer charging member, which is disposed so as to contact said developer carrying body at a downstream side of said regulating member and at an upstream side of the developing position in a developer carrying direction of said developer carrying body, for charging the developer carried by said developer carrying body, a voltage being applied to said developer charging member;

wherein a period when a developing action is not conducted by said developer carrying body includes a first period that a first electric field is formed in a direction in which a normally-charged developer moves from said developer carrying body to said developer charging member, and a second period that, after the first period, a second electric field is formed in a direction in which the normally-charged developer moves from said developer charging member to said developer carrying body.

2. A developing apparatus according to claim 1, wherein in case where the voltage applied to said developer charging member is assumed to be V1 and a voltage applied to said developer carrying body is assumed to be V2, when the first electric field is formed, (V1–V2) has a reversed polarity relative to a charging polarity of a normally charged developer and when the second electric field is formed, (V1–V2) has a same polarity as a charging polarity of the normally-charged developer.

3. A developing apparatus according to claim 2, wherein V1 and V2 are 0 V or a direct current voltage.

4. A developing apparatus according to claim 2, wherein (V1- V2 ), which is smaller than a discharge starting voltage across said developer charging member and said developer carrying body.

5. A developing apparatus according to claim 1, wherein when the first electric field is formed, a potential difference between said developer carrying body and said developer charging member is constant in a predetermined period and when the second electric field is formed, a potential difference between said developer carrying body and said developer charging member is constant in a predetermined period.

6. A developing apparatus according to claim 1, wherein said developer carrying body is rotatable and in the first period when the first electric field is formed, said developer carrying body rotates for at least 1 cycle.

7. A developing apparatus according to claim 1 or 6, wherein said developer carrying body is rotatable and in the second period when the second electric field is formed, said developer carrying body rotates for at least 1 cycle.

8. A developing apparatus according to claim 1, further comprising a supplying member, which is disposed so as to contact said developer carrying body for supplying the developer to said developer carrying body.

9. A developing apparatus according to claim 1, wherein when the developing action is effected, a voltage, which is equal to or higher than a discharge starting voltage is applied to said developer charging member.

10. A developing apparatus according to claim 9, wherein when the first electric field and the second electric field are formed, a voltage smaller than the discharge starting voltage is applied to said developer charging member.

11. A developing apparatus according to claim 1, wherein said developing apparatus is attachable to and detachable from a main body of an image forming apparatus.

12. A developing apparatus according to claim 1, wherein said developing apparatus is provided in a processing cartridge attachable to and detachable from a main body of an image forming apparatus, together with said image bearing body.

13. A developing apparatus according to claim 1, wherein said developer carrying body is disposed so as to contact said image bearing body.

* * * * *

UNITED STATES PATENT AND TRADEMARK OFFICE

CERTIFICATE OF CORRECTION

PATENT NO. : 6,542,710 B2
DATED : April 1, 2003
INVENTOR(S) : Tomomi Kakeshita et al.

It is certified that error appears in the above-identified patent and that said Letters Patent is hereby corrected as shown below:

Column 2,
Line 37, “and” should read -- end --.

Column 4,
Line 32, “operates the above described action repeated” should read -- operates so that the above-described action is repeated --; and
Line 40, “non magnetic” should read -- nonmagnetic --.

Column 5,
Line 27, “to inside” should read -- inside of --;
Line 29, “to outside” should read -- outside of --; and
Line 32, “to” should be deleted.

Column 9,
Line 8, “Here,” should read -- Now, the --;
Line 10, “18” should read -- 18 will be discussed --; and
Line 20, “presents” should read -- is present --.

Column 10,
Line 14, “Dvdc” should read -- Dvdc -- (both occurrences).

Column 12,
Line 23, “(V1- V2), which” should read -- (V1-V2) --; and
Line 47, “voltage” should read -- volrage, --.

Signed and Sealed this

Seventh Day of October, 2003

JAMES E. ROGAN
*Director of the United States Patent and Trademark Office*